US007357618B2

(12) United States Patent
Burdgick et al.

(10) Patent No.: US 7,357,618 B2
(45) Date of Patent: Apr. 15, 2008

(54) FLOW SPLITTER FOR STEAM TURBINES

(75) Inventors: Steven Sebastian Burdgick, Schenectady, NY (US); Thomas William Crall, Jr., Jonesville, NY (US)

(73) Assignee: General Electric Company, Schenectady, NY (US)

( * ) Notice: Subject to any disclaimer, the term of this patent is extended or adjusted under 35 U.S.C. 154(b) by 358 days.

(21) Appl. No.: 11/136,470

(22) Filed: May 25, 2005

(65) Prior Publication Data

US 2006/0269397 A1 Nov. 30, 2006

(51) Int. Cl.
*F01D 3/02* (2006.01)

(52) U.S. Cl. ..... 415/103

(58) Field of Classification Search ..... 415/93, 415/101, 103

See application file for complete search history.

(56) References Cited

U.S. PATENT DOCUMENTS

| | | | | |
|---|---|---|---|---|
| RE32,685 | E * | 5/1988 | Hess | 415/139 |
| 4,826,395 | A * | 5/1989 | Groenendaal, Jr. | 415/101 |
| 5,024,579 | A * | 6/1991 | Groenendaal et al. | 415/108 |
| 6,048,169 | A * | 4/2000 | Feldmuller et al. | 415/115 |
| 6,082,962 | A * | 7/2000 | Drosdziok et al. | 415/115 |

* cited by examiner

*Primary Examiner*—Edward K. Look
*Assistant Examiner*—Devin Hanan
(74) *Attorney, Agent, or Firm*—Nixon & Vanderhye, PC

(57) ABSTRACT

A flow splitter directs inlet steam in axially opposite directions in a double flow steam turbine. The flow splitter includes a main ring having a radially outer apex with annular concave surfaces extending inwardly from and in opposite axial directions on opposite axial sides of the apex. A second ring is secured on one axial side of the main ring by welding to the main ring and has a concave outer surface portion which completes the concave surface of the flow splitter along the opposite axial side of the flow splitter.

18 Claims, 3 Drawing Sheets

FLOW SPLITTER FOR STEAM TURBINES

The present invention relates to a flow splitter for splitting inlet steam in a double flow axial steam turbine and particularly relates to flow splitter having a main ring forming the majority of the flow splitter and a second smaller ring forming the remainder of the flow splitter, the rings being welded to one another.

BACKGROUND OF THE INVENTION

In double flow steam turbines, the inlet steam is typically split for flow into two axially opposite directions. This is typically accomplished using a component commonly referred to as a flow splitter or a tub. Upon splitting the inlet steam, the steam flows axially in opposite directions through nozzle and bucket stages on each side of the flow splitter. Current flow splitter designs are massive structures that are both costly and heavy. Typically they comprise two mirror image axial halves bolted together with large bolts through massive flanges forming a bolt circle along an inside radial surface between the flow splitter and the rotor. Each half of the flow splitter is conventionally machined from a very large forging which results in a significant quantity of waste material machined from the original stock. After machining, the flow splitter halves are bolted one to the other using the bolt circles along the inner flanges of the flow splitter. Not only do such current flow splitters require significant excessive costly machining with consequent material waste, but the radially inwardly directed flanges and bolts cause significant windage loss. That is, leakage steam is extant in the annular space between the flow splitter and the rotor and hence rotation of the rotor creates friction on its surface as well as those surfaces of the flow splitter, increasing the temperature of the cavity and decreasing the efficiency of the turbine. Consequently, there has developed a need for a flow splitter which will reduce costs and improve steam turbine efficiency.

BRIEF DESCRIPTION OF THE INVENTION

In a preferred embodiment of the present invention, there is provided apparatus for directing inlet steam in axially opposite directions in a steam turbine comprising a flow splitter having an apex and outer annular concave surfaces extending inwardly from the apex and in opposite axial directions on opposite axial sides of the apex; the flow splitter being formed of first and second rings welded to one another with each ring having respective portions of the concave surfaces.

In a further preferred embodiment of the present invention, there is provided a flow splitter for directing inlet steam in axial opposite directions in a steam turbine comprising a first ring having a radially outer apex with annular outer concave surfaces extending inwardly from and on opposite sides of the apex; a second ring on one side of and welded to the first ring, the second ring having a concave outer surface portion forming a continuation of the concave surface along the one side of the first ring.

In a further preferred embodiment of the present invention, there is provided a flow splitter for directing inlet steam in axially opposite directions in a steam turbine comprising a main ring having a radially outer apex with outer concave surfaces extending inwardly from and in opposite axial directions on opposite axial sides of the apex, the main ring having an annular groove opening adjacent one axial side thereof; a second ring having at least a portion thereof received in the groove and having a concave outer surface portion forming a continuation of the concave surface along the one axial side of the main ring; and a weld between the main ring and the second rings securing the rings to one another.

DETAILED DESCRIPTION OF THE INVENTION

Figure 1:
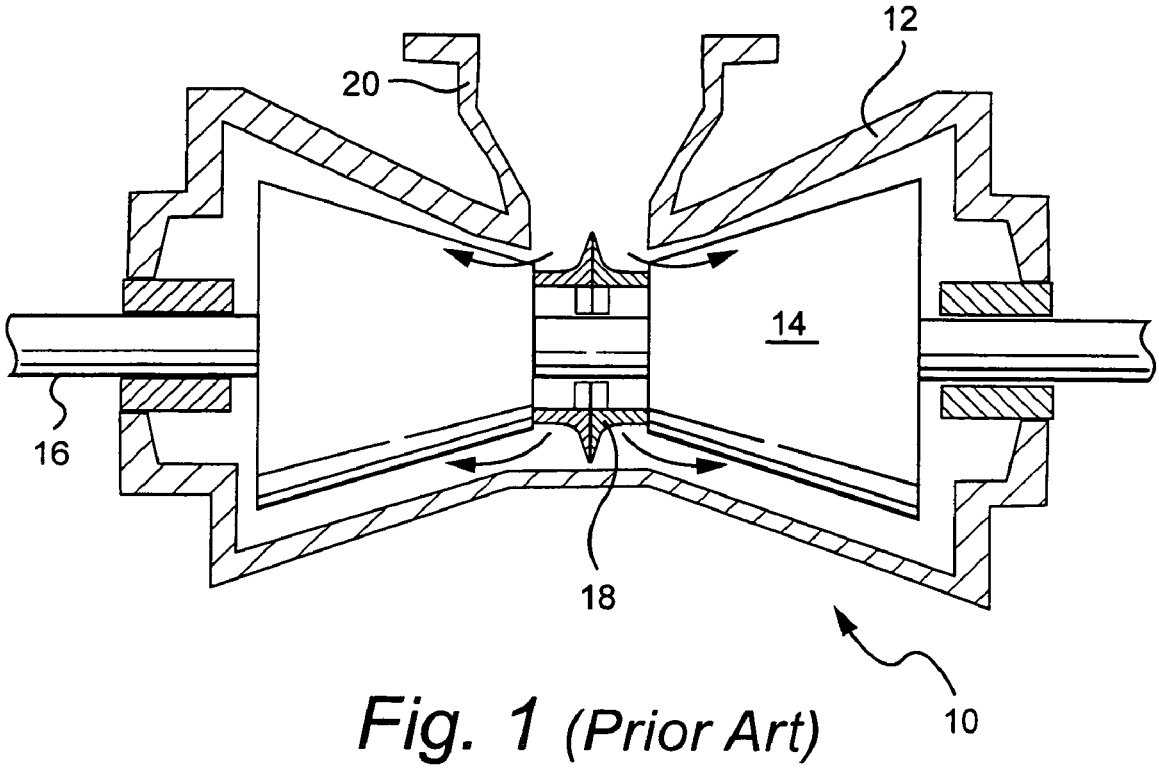
Fig. 1 (Prior Art)
FIG. 1 is a schematic horizontal cross-sectional view of a typical double flow steam turbine according to the prior art.
Figure 2:
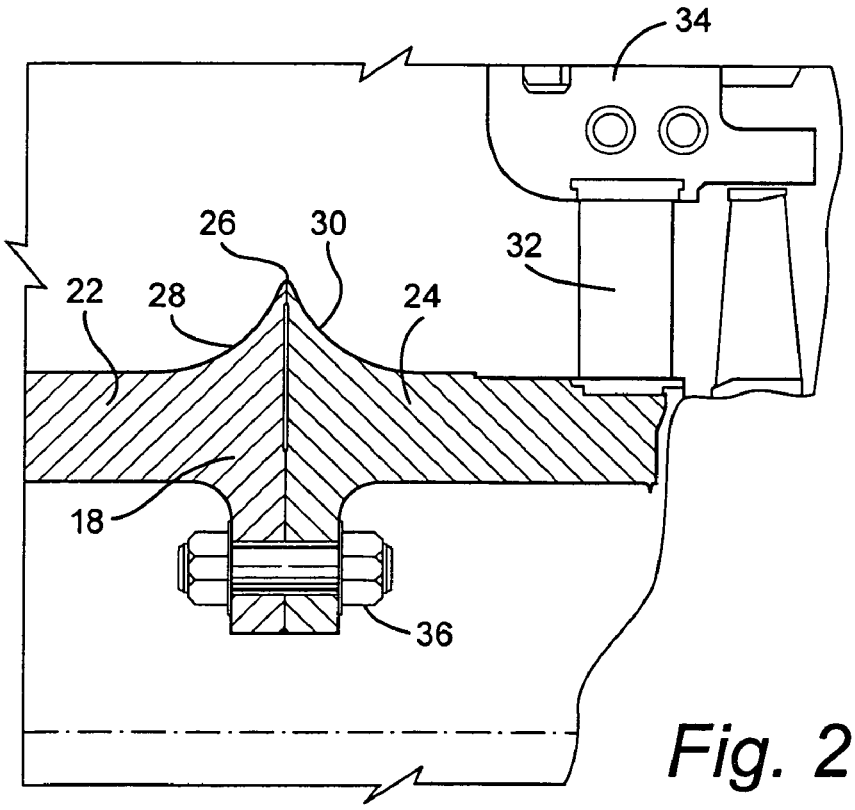
Fig. 2 (Prior Art)
FIG. 2 is a fragmentary enlarged cross-sectional view illustrating the typical flow splitter of FIG. 1 comprised of two halves bolted to one another.

Referring now to the drawing figures, particularly to FIG. 1, there is illustrated a typical turbine, e.g. a steam turbine, generally designated 10. Turbine 10 includes an outer casing 12, an inner casing 14 and a plurality of nozzles and buckets forming plural stages on each of the axial spaced sides of the double flow turbine. Turbine 10 also includes a rotor 16 mounting the buckets, the rotor- 16 extending through opposite axial ends of the turbine and within an annular flow splitter or tub 18. The flow splitter 18 is located centrally of the turbine and receives steam through a steam inlet 20 for flow to the various turbine stages on the axially opposite sides of the flow splitter 18. Particularly, the flow splitter 18 as illustrated in FIG. 2 includes opposite halves 22 and 24 which are mirror images of one another. As illustrated, the flow splitter 18 comprises an annulus having an apex 26 aligned with the center of the inlet 20 and annular concave surfaces 28 and 30 which transition to the partitions 32 fixed between the flow splitter and an inner shell 34. Thus, steam enters radially of the turbine and splits for axial flow in opposite directions through the various stages on opposite sides of the flow splitter.

As illustrated in FIG. 2, the conventional flow splitter 18 includes a flange extending radially inwardly from each of the flow splitter halves 22 and 24. Each flange mounts a bolt circle whereby the flow splitter halves 22 and 24 are secured one to the other by bolts 36. As illustrated in FIG. 1, the flanges are located radially inwardly of the flow splitter and in a region between the flow splitter and rotor which receives leakage steam.

Figure 3:
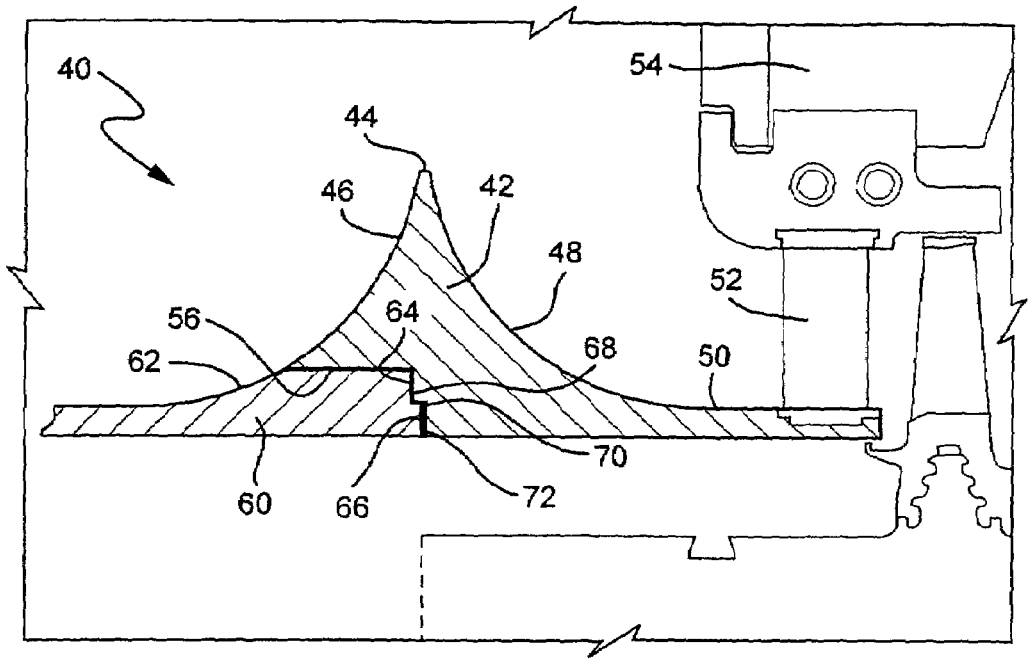
FIG. 3 is a fragmentary cross-sectional view of a flow splitter constructed in accordance with a preferred aspect of the present invention.

Referring now to drawing FIG. 3, there is illustrated a flow splitter generally designated 40 constructed in accordance with an aspect of the present invention. Flow splitter 40 includes a first or main ring 42 having a radially outer apex 44 with outer concave annular surfaces 46 and 48 extending inwardly from and in axially opposite directions on opposite sides of the apex 44. The concave surface 48 on one axial side of apex 44 transitions into a generally axially extending annular surface 50 which mounts the inner ends or inner ring of partitions 52 forming part of a first stage of the steam turbine. The outer ring or tip of the partition 52 is secured to an inner shell 54. The main ring 42 also includes an annular groove 56 opening adjacent an opposite axial side of the main ring and which groove opens along a radial inner surface thereof.

Flow splitter 40 further includes a second ring 60 which has annular portions received within the groove 56. A second ring 60 also includes a concave outer surface portion 62 which forms a continuation of the concave surface 46 along the one axial side of the main ring 42. Consequently when the two rings are assembled, complete mirror image concave annular surfaces extend from the annular apex 44 in opposite axial directions to split the flow of the inlet steam for flow in opposite axial directions.

To secure the first and second rings to one another to form the complete assembled flow splitter 40, an axial face of the groove 56 formed in flow splitter half 42 has stepped axially facing surfaces 64 and 66. The second ring 60 includes complementary-shaped surfaces 68 and 70 facing an opposite axial direction. The surfaces 64, 66, 68 and 70 extend in a radial direction. The surfaces 66 and 70 are preferably welded to one another, for example by a low heat input type of weld. A laser weld, "flux"—TIG weld or other welding method and equipment using a butt type joint to reduce shrinkage and distortion may be utilized, although a traditional "J" weld interface could be used. Thus, the flow splitter halves 42 and 60 are welded to one another along their abutting axial radially inner surfaces, the welded joint being designated 72 in FIG. 3. This weld could occur prior to or after securement of the nozzle assembly to the outer ring and/or tub.

It will be appreciated from a review of FIG. 3 that the welded joint 72 between the flow splitter rings 42 and 60 entirely eliminates the inwardly projecting flanges and necessary bolts illustrated in the conventional flow splitter design of FIGS. 1 and 2. This eliminates or minimizes the windage problem associated with the flanges and bolts and the resulting higher temperatures and lower efficiency of steam turbines using the flow splitter of the conventional design. In comparison, the inner surfaces of each of the rings 42 and 60 of the flow splitter hereof constitute continuous non-interrupted cylindrical surfaces. Also, the flow splitter main ring 42 may be formed of a forging having a lesser radial extent than the forging necessary to form the flow splitter halves illustrated in FIGS. 1 and 2. This reduces costs by reducing machining and material costs. Further, the second ring 60 need not be a forging but may comprise a rolled ring again decreasing costs.

Figure 4:
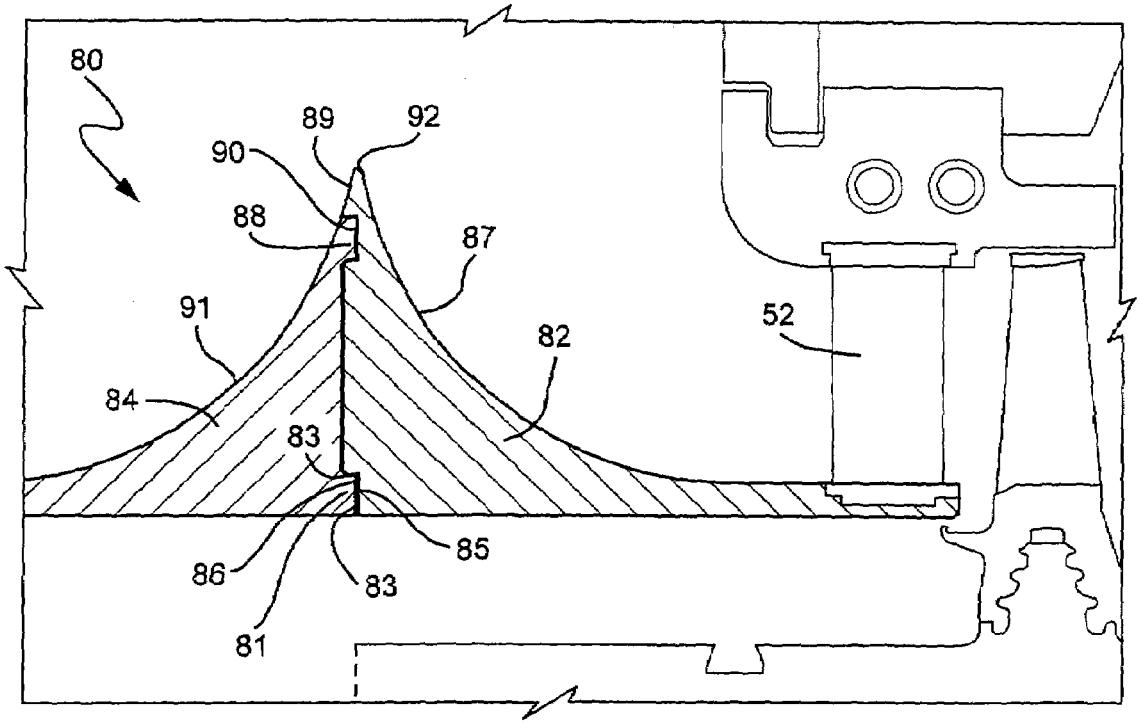
FIG. 4 is a view similar to FIG. 3 illustrating another aspect thereof.

Referring now to FIG. 4, there is illustrated a further aspect of the present invention. The flow splitter 80 in FIG. 4 includes a main ring 82 and a second ring 84 welded to one another along axially abutting surfaces, i.e., along a projection 81 of a complementary recess. The weld 86 is provided along radially inner axially abutting surfaces inwardly of a step 87 in the axial facing surface of main ring 82. In this aspect, the second ring 84 includes an annular projection 88 for reception in a recess 90 on the axial face of ring 82. The projection 88 and recess 90 may be axially reversed. The cooperating projection and recess enable the weld to be placed more in tension than in a bending mode in light of the high pressure in a radial inward direction developed from the steam flow on the concave surfaces of the rings. As illustrated, the main ring 82 includes a complete concave continuous surface 87 from the apex 92 of the flow splitter 80 to its horizontal transition at the base of the partitions 52. The main ring 82 also includes a portion 89 of the annular concave surface extending from the apex 92 in the axial opposite direction with the remaining portion of that concave surface being provided by the annular concave surface of the second ring 84.

Figure 5:
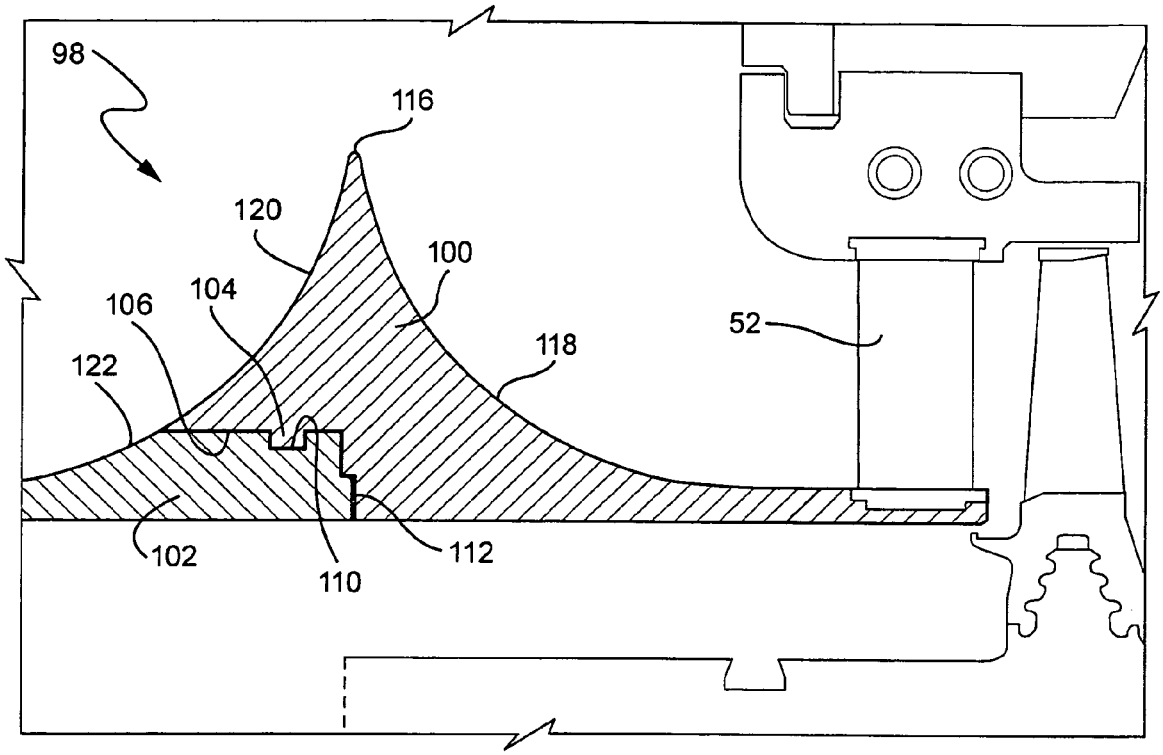
FIG. 5 is a view similar to FIG. 3 illustrating a further aspect thereof.

In FIG. 5, there is illustrated a flow splitter, generally designated 98, having main and second annular rings 100 and 102 which has the foregoing described benefits. In this embodiment, similar to the embodiment of FIG. 3, an additional projection 104 is provided along the horizontal surface of the groove 106 formed in the main ring 108. The second ring 102 includes a recess 110 which receives the projection 104. The weld 112 is provided at the same location as in the embodiment of FIG. 3, i.e., at axially abutting surfaces. By providing a projection and recess combination along the horizontal surface 106, the main and second rings are prevented from axial separating movement relative to one another in the event the weld 112 fails. The flow splitter 98 also includes as in the prior embodiments, an apex 116, outer annular concave surfaces 118 and 120 on the main ring 100 extending in opposite axial directions and an outer annular surface 122 on the second ring 102.

From a review of FIGS. 3 through 5, it will be appreciated that the load path of the steam turbine is in an axial direction and thus a flow splitter does not require substantial strength in the radial or circumferential direction. Moreover, the present flow splitter makes efficient use of stock material and is much less costly than conventional flow splitters since the present flow splitter may utilize a single forging for the main ring and a rolled ring for the second ring. The present flow splitter also reduces thermal stresses and minimizes the effects of windage on the turbine thereby improving turbine efficiency.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for directing inlet steam in axially opposite directions in a steam turbine comprising:

a flow splitter having an apex and outer annular concave surfaces extending inwardly from said apex and in opposite axial directions on opposite axial sides of said apex;

said flow splitter being formed of first and second rings welded to one another with each ring having respective portions of said concave surfaces.

2. Apparatus according to claim 1 wherein said rings have axially abutting surfaces and said weld lies along said axially abutting surfaces.

3. Apparatus according to claim 1 wherein each of said rings has a pair of stepped axially facing surfaces complementary to the pair of stepped axially facing surfaces of another of said rings.

4. Apparatus according to claim 3 wherein said stepped surfaces of one of said rings are radially spaced from one another and said step surfaces of another of said rings are radially spaced from one another, innermost of said step surfaces of said rings abutting and being welded to one another.

5. A flow splitter for directing inlet steam in axial opposite directions in a steam turbine comprising:

a first ring having a radially outer apex with annular outer concave surfaces extending inwardly from and on opposite sides of said apex;

a second ring on one side of and welded to said first ring, said second ring having a concave outer surface portion forming a continuation of the concave surface along said one side of said first ring.

6. A flow splitter according to claim 5 wherein each of said rings has a pair of stepped axially facing surfaces complementary to the pair of stepped axially facing surfaces of another of said rings.

7. A flow splitter according to claim 6 wherein said stepped surfaces of said first ring are radially spaced from one another and said stepped surfaces of said second ring are radially spaced from one another, innermost of said stepped surfaces of said rings abutting and being welded to one another.

8. A flow splitter according to claim 5 wherein said rings have axially abutting surfaces, one of said rings having a pair of annular axially extending projections and another of said rings having a pair of annular axially facing recesses for receiving said projections.

9. A flow splitter according to claim 5 wherein said rings have respective radially outwardly and radially inwardly facing abutting surfaces, one of said radially abutting surfaces including a radial projection and another of said radially abutting surfaces including a radial recess for receiving said projection for securing said rings to one another against axial separating movement.

10. A flow splitter for directing inlet steam in axially opposite directions in a steam turbine comprising:

a main ring having a radially outer apex with outer concave surfaces extending inwardly from and in opposite axial directions on opposite axial sides of said apex, said main ring having an annular groove opening adjacent one axial side thereof;

a second ring having at least a portion thereof received in said groove and having a concave outer surface portion forming a continuation of the concave surface along said one axial side of said main ring;

and a weld between said main ring and said second rings securing said rings to one another.

11. A flow splitter according to claim 10 wherein said rings have axially abutting surfaces and said weld lies along said axially abutting surfaces.

12. A flow splitter according to claim 11 wherein said axially abutting surfaces include radially innermost surfaces thereof.

13. A flow splitter according to claim 10 wherein each of said rings has a pair of stepped axially facing surfaces complementary to the pair of stepped axially facing surfaces of another of said rings.

14. A flow splitter according to claim 13 wherein stepped surfaces of said main ring are radially spaced from one another and each of said stepped surfaces of said second ring are radially spaced from one another, innermost of said stepped surfaces of said rings abutting and being welded to one another.

15. A flow splitter according to claim 10 wherein radially innermost surfaces of said rings are cylindrical and form continuations of one another when said rings are welded to one another.

16. A flow splitter according to claim 10 wherein said annular groove of said main ring opens along a radial inner surface thereof.

17. A flow splitter according to claim 16 wherein said rings have axially abutting surfaces, one of said rings having a pair of annular axially extending projections and another of said rings having a pair of annular axially facing slots for receiving said projections.

18. A flow splitter according to claim 10 wherein said annular groove of said main ring opens along a radial inner surface thereof and has one of a radially inner annular projection or a radially outer annular recess, said second ring portion having one of a complementary radially outer projection or a complementary radially inner recess for securing said rings against axial separating movement.

* * * * *